United States Patent [19]

O'Loughlin

[11] 4,267,484

[45] May 12, 1981

[54] PARALLEL MULTI-ELECTRODE SPARK GAP SWITCH

[75] Inventor: James P. O'Loughlin, Albuquerque, N. Mex.

[73] Assignee: The United States of America as represented by the Secretary of the Air Force, Washington, D.C.

[21] Appl. No.: 70,383

[22] Filed: Aug. 28, 1979

[51] Int. Cl.[3] ..... H01J 17/00; H01J 21/00

[52] U.S. Cl. ..... 313/325; 313/156; 313/309; 361/127; 361/133

[58] Field of Search ..... 313/325, 156, 146, 198, 313/157, 309; 361/128, 129, 130, 133

[56] References Cited

U.S. PATENT DOCUMENTS 2,862,132 11/1958 Dyer, Jr. ..... 313/156

3,798,484 3/1974 Rich ..... 313/325

4,056,753 11/1977 Keikichi et al. ..... 313/325

*Primary Examiner*—Saxfield Chatmon, Jr.

*Attorney, Agent, or Firm*—Joseph E. Rusz; Henry S. Miller

[57] ABSTRACT

A spark gap switching device for high peak currents including a pair of main electrodes with protruding, opposing sub-electrodes, surrounded by high permeability cores typically of ferrite material. Small air gaps separate the sub-electrodes. The switch is activated by an over voltage or the like causing one of the sub-electrodes to breakover producing a flux time rate of change in the core. A voltage is induced in the non conducting sub-electrodes causing aligned pairs to rapidly increase in potential difference until one by one they all conduct.

2 Claims, 5 Drawing Figures

PARALLEL MULTI-ELECTRODE SPARK GAP SWITCH

STATEMENT OF GOVERNMENT INTEREST the invenion described herein may be manufactured and used by or for the Government for governmental purposes without the payment of any royalty thereon.

BACKGROUND OF THE INVENTION

The invention relates generally to spark gap switching devices and, more particularly, to such switching instruments for use in circuits with high peak currents.

Spark gap devices are well established in the elctrical art. Originally, spark gap switching was used primarily in devices designed to protect a circuit or system from unwanted bursts of peak current.

Later, this method of switching found a use in high energy pulse devices. Difficulties have arisen where high peak currents are used repeatedly however, in that there is a high erosion rate of the spark gap material due to the concentration of high peak current. This necessitates substantially built electrodes a frequent replacement.

Another problem encountered in the utilization of spark gaps, for switching high peak currents, is where inductance in the gap limits switching time due to the high time rate of change of current through the inductance.

A solution to the problem is to distribute the current among several parallel gaps. However, although the problem has been relatively simple to define, the solution is complicated to realize. The increased size and volume of several gaps is awkward to implement. Additionally, the problem of simultaneously triggering and making a plurality of gaps turn on at the same time and share the load is difficult due to the many variables involved in the process.

The invention provides for the arrangement of many "subelectrodes" in a compact configuration wth a simple means of causing a uniform distribution of current, a reduction in inductance and a corresponding decrease in the erosion of electrodes.

SUMMARY OF THE INVENTION

The invention relates to a spark gap switch particularly adapted to switch high peak currents.

A pair of electrodes of sufficient size to handle the current requirement of the circuit are aligned along a common axis but in spaced apart relationship. Each electrode is surrounded by a core having a high factor of permeability. The cores are located at the end of the electrode nearest the adjoining electrode.

Extending out from each electrode toward the opposite electrobe are a plurality of small extensions or "sub-electrodes". These sub-electrodes are parallel and extend toward a corresponding sub-electrode on the opposing electrode. The space between opposing sub-electrodes forms a spark gap. The sub-electrodes are formed on the main electrode and the number and pattern of the sub-electrodes can vary. in designing a device to solve the aforementioned problems, the following factors constitute important considerations; the number, length, spacing and cross section of the sub-electrodes, and the area, permeability and saturation flux of the core. The length, spacing and cross section of the sub-electrodes determine the inductance associated with each and is given by;

$$L=b/(3R^3) \text{ ab henries per sub-electrode} \quad (1)$$

when: b=length of sub-electrodes (cm)

R=radius of equivalent circular cross section of the sub-electrode ($cm^2$)

The number of sub-electrodes and the inductance per each establishes the lower limit of the total switch inductance and is therefore an important consideration. The core is important during the turn-on time of the assembly, that is, its area and saturation flux density must be adequate to insure the core does not saturate before sufficient over voltage and time have been applied to turn on all the sub-electrodes. Alternatively, the core should not cause too long a delay time in the turn-on, nor should its saturated inductance be too high, which dictates a proper choice of material and geometry to meet the desired operating characteristics.

The invention is small and light compared to similar switches currently available and accordingly this feature is one of the prime objects of the invention.

Due to its size, this spark gap switch would have particular application in airborne and spaceborne high energy pulse modulators such as those used to drive electric discharge lasers and electron beam pulsed initiators for chemical lasers.

Other objects of the invention are to provide a new and improved spark gap switch for high currents with a faster switching time then any similar known device.

It is another object of the invention to provide a new and improved spark gap switch that has a reduced electrode erosion and hence a longer life.

It is a further object of the invention to provide a new and improved spark gap switch that utilizes a plurality of subelectrodes to distribute the high current effectively.

It is still another object of the invention to provide a new and improved spark gap switch that provides coupling between sub-electrodes as a compact, simple, inetgral part of the design.

These and other advantages, features and objects of the invention will become more apparent from the following description taken in connection with the illustrative embodiment in the accompanying drawings.

DESCRIPTION OF THE PREFERRED EMBODIMENT

Figure 1:
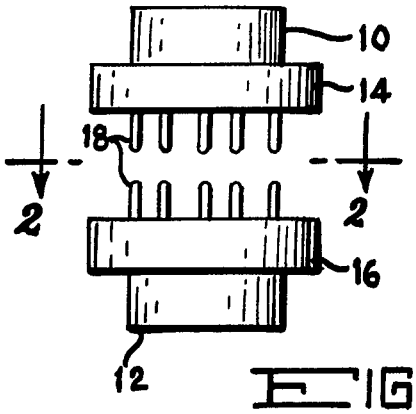
FIG. 1 is a side elevational view of the invention partly in section.

Referring now to FIG. 1, the invention consists of a pair of main electrodes 10, 12 constructed of a conductive material such as copper and of suitable size to conduct the designed for current. One electrode is connected to an energy source, while the other electrode is connected to an energy consuming device, in a typical switching configuration. The electrodes lie along a common axis with their ends separated by a designated air gap.

An area near one end of each main electrode is encompassed by a high permeability core (14, 16) typically formed of a ferrite material but other suitable materials could be used. Extending outwardly from each main electrode, parallel to the common axis and toward the facing electrodes are a plurality of projections 18 termed "sub- electrodes". Each sub-electrodes extends from the peripheral edge of the main electrode and is aligned with a corresponding sub electrode on the facing electrode and having a dome shaped end.

Figure 2:
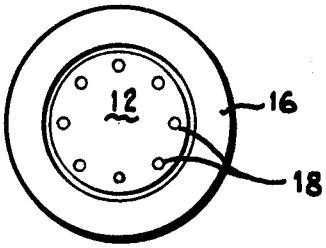
FIG. 2 is an end view of one electrode.

FIG. 2 shows an end view of an electrode with electrode 12, encompassed by core 16 and eight sub-electrodes 18 extending outwardly from the drawing.

Figure 3:
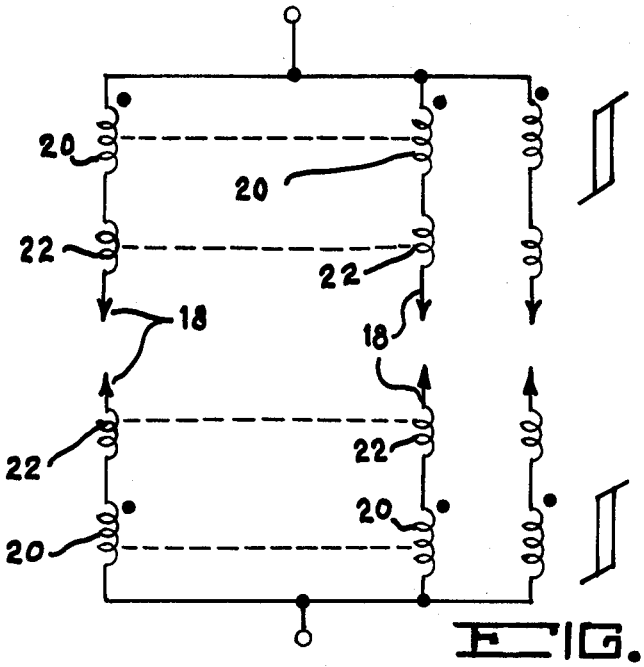
FIG. 3 is an equivalent circuit of the invention.

An equivalent circuit of the invention is shown in FIG. 3. A series of saturable inductances 20 represent high permeability core 14. Mutual inductances 22 couples each of the inductances of sub-electrodes 18.

In operation, a means is provided for triggering the switch. A number of conventional methods may be utilized for triggering including, by over voltage or trigger electrodes such as a mid-plane trigger.

Under appropriate circumstances ultra violet radiation would provide a sufficient triggering mechanism.

The triggering action will cause one of the sub-electrobe pairs to break over and conduct before the other pairs. As this happens, the current build up in that pair will cause a flux time rate of change in high permeability core (14, 16) which, by transformer action, will induce a voltage in the non conducting sub electrodes. This effect will cause the remaining aligned pairs to rapidly increase in potential difference. A rapid increase in potential difference will force the non conducting sub-electrode pairs to break down one by one until all are conducting. As each of the sub-electrode pairs becomes conductive the impedance (inductance) in the switch lowers and, the greater the current becomes, the higher the potential difference between the non conducting pairs. Hence, as soon as the first pair of sub-electrodes conducts, an unstable situation develops which rapidly forces the conduction of all sub-electrodes.

Figure 4A:
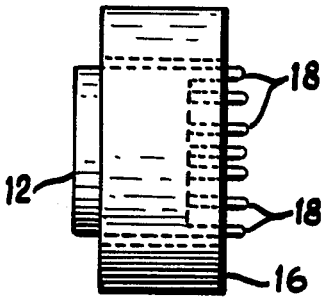
FIG. 4*a* is a side elevation view of the invention partly in section.
Figure 4B:
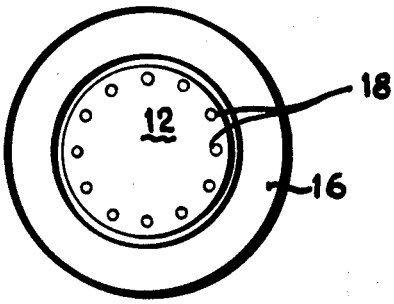
FIG. 4*b* is an end view of the electrode of FIG. 4*a*

An example of the invention is shown in FIG. 4, wherein twelve sub-electrodes (18) each one cm long are spaced about a circle having a diameter of 2.55 cm. Core 16 is ferrite with a cross section of 2 $cm^2$ and a mean diameter of 3.75 cm. The permeability of the core is 3000 and the saturation flux density is 4000 gauss. Each sub-electrode has an inductance of approximately 43 nh and an unsaturated value of approximately 8 nh. the volt-second stand-off time of the core is 40 volt-micro seconds. If this gap is used for switching in a two ohm 30 kv circuit, the initial di/dt when the first sub-electrode fires is $3.75 \times 10^9$ ampere/seconds which will induce an initial over voltage approaching 225 kilovolts which, as a practical matter, will never completely develop because the remaining sub-electrodes will be forced into conduction nearly instantaneously.

Although the invention has been described with reference to a particular embodiment, it will be understood to those skilled in the art that the invention is capable of a variety of alternative embodiments within the spirit and scope of the appended claims.

I claim:

1. A spark gap switching device comprising first and second electrodes of conductive material, each said electrode being cylindrical in shape and terminating in a plurality of spaced juxtaposed rod shaped sub-electrodes of conductive material extending perpendicularly from an end surface thereof, said electrodes being positioned such that the ends of the sub-electrodes of each electrode are in close proximity and in register with the ends of corresponding sub-electrodes of the other electrode forming spark gaps therebetween, and means for effecting substantial saturable mutual inductance between adjacent sub-electrodes.

2. A spark gap switching device as defined in claim 1 wherein said means for effecting saturable mutual inductance comprises a core of high permeability material surrounding the sub-electrodes of each electrode.

* * * * *